US006650250B2

(12) United States Patent
Muraki

(10) Patent No.: US 6,650,250 B2
(45) Date of Patent: Nov. 18, 2003

(54) PARKING LOT GUIDANCE SYSTEM AND PARKING LOT GUIDANCE PROGRAM

(75) Inventor: Norichika Muraki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/136,162

(22) Filed: May 1, 2002

(65) Prior Publication Data

US 2002/0171562 A1 Nov. 21, 2002

(30) Foreign Application Priority Data

May 21, 2001 (JP) ..... 2001-151514

(51) Int. Cl.[7] ..... G08G 1/14

(52) U.S. Cl. ..... 340/932.2; 340/990; 340/995; 701/200

(58) Field of Search ..... 340/932.2, 933, 340/988, 995, 937, 990; 701/200

(56) References Cited

U.S. PATENT DOCUMENTS 5,432,508 A * 7/1995 Jackson ..... 340/932.2
6,266,609 B1 * 7/2001 Fastenrath ..... 701/200
6,426,708 B1 * 7/2002 Trajkovic et al. ..... 340/932.2
2002/0147543 A1 * 10/2002 Gieseke ..... 701/200
2003/0074129 A1 * 4/2003 Curbow et al. ..... 702/200

* cited by examiner

*Primary Examiner*—Nina Tong
(74) *Attorney, Agent, or Firm*—Rosalio Haro

(57) ABSTRACT

A parking lot guidance system guides parking lot users to empty parking spaces in a large-scale parking lot in a way that is easy for the user to understand. The parking lot guidance system N has vehicle detection units 1 for detecting vehicles parked in parking spaces, a control unit 2 for generating parking space availability data for the parking lot based on detection results from the vehicle detection units 1, a parking lot map storage unit 3 for storing maps of the parking lot, an empty space data storage unit 4 for storing the empty parking space data generated by the control unit 2, and data transmitters 6 for sending the empty parking space data to optical beacons 5 located at various places throughout the parking lot. The parking lot is preferably divided into multiple parking blocks, and data indicating whether any of those blocks as an available parking space is sent to vehicles V. When entering a specific parking block, data indicating the location of available parking spaces are sent to the vehicles. These data are sent to the vehicles by optical beacons 5, and presented pictorially on an on-board display in the vehicles.

8 Claims, 9 Drawing Sheets

Empty Parking Space Data I1 For Parking Block Unit

Empty Parking Space Data I2 For Each Parking Block

BLOCK A

| | | | | | | |
|---|---|---|---|---|---|---|
| a1 | a2 | a3 | a4 | a5 | a6 | a7 |
| a8 | a9 | a10 | a11 | a12 | a13 | a14 |

BLOCK C

| | | | | | | |
|---|---|---|---|---|---|---|
| c1 | c2 | c3 | c4 | c5 | c6 | c7 |
| c8 | c9 | c10 | c11 | c12 | c13 | c14 |

BLOCK B

| | | | | | | |
|---|---|---|---|---|---|---|
| b1 | b2 | b3 | b4 | b5 | b6 | b7 |
| b8 | b9 | b10 | b11 | b12 | b13 | b14 |

BLOCK D

| | | | | | | |
|---|---|---|---|---|---|---|
| d1 | d2 | d3 | d4 | d5 | d6 | d7 |
| d8 | d9 | d10 | d11 | d12 | d13 | d14 |

FIG._4a

BLOCK A

| | | | | | | |
|---|---|---|---|---|---|---|
| 1 | 1 | 1 | 1 | 1 | 1 | 1 |
| 1 | 1 | 1 | 1 | 1 | 1 | 1 |

BLOCK C

| | | | | | | |
|---|---|---|---|---|---|---|
| 1 | 1 | 1 | 1 | 1 | 1 | 1 |
| 1 | 1 | 1 | 1 | 1 | 1 | 1 |

BLOCK B

| | | | | | | |
|---|---|---|---|---|---|---|
| 1 | 1 | 0 | 1 | 1 | 0 | 1 |
| 0 | 1 | 1 | 1 | 1 | 1 | 1 |

BLOCK D

| | | | | | | |
|---|---|---|---|---|---|---|
| 1 | 1 | 1 | 1 | 1 | 1 | 1 |
| 1 | 1 | 1 | 1 | 1 | 1 | 1 |

FIG._4b

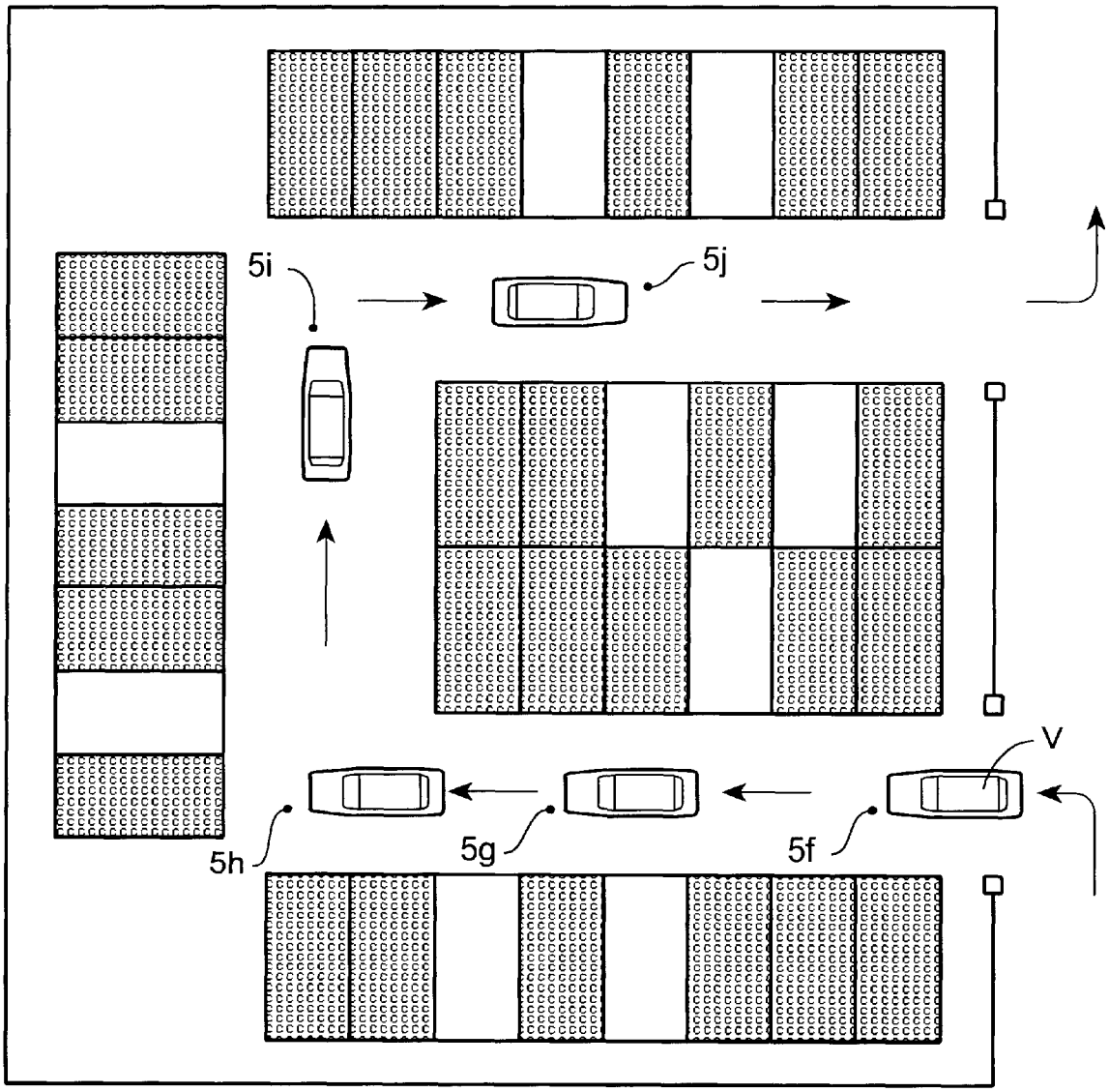
FIG._8 BLOCK E (Parking Lot Q)

PARKING LOT GUIDANCE SYSTEM AND PARKING LOT GUIDANCE PROGRAM

BACKGROUND OF THE INVENTION

1. Field of the Invention

The present invention relates generally to a parking lot guidance system, and relates specifically to a parking lot guidance system for guiding to an open parking space vehicles entering a large-scale parking lot.

2. Description of the Related Art

Various systems have been proposed for guiding to an open parking space vehicles entering a parking lot, such as the kind of large-scale parking lot found at shopping centers. The parking lot management system shown in Japanese Patent Laid-Open Publication (kokai) H11-195199, for example, presents, at the entrance to the parking lot, the location of an open parking space, lends a communication terminal having an IC card to the parking lot user ("driver" below), and uses text displays or audio output from the communication terminal to guide the driver to the open parking space.

A problem with the prior art guidance system taught in Kokai H11-195199, however, is that it is difficult for the driver to know the location of the open parking space because the driver is guided to the open space with text or audio guidance from a communication terminal inside the parking lot.

A further problem is that it is difficult for the driver to know the position of the open parking space relative to the driver's own current location. Furthermore, if the relationship between these two positions is unclear, and it is easy for the driver to become lost inside the parking lot.

OBJECTS OF THE INVENTION

The present invention is directed to solving these problems, and an object of the invention is to provide a parking lot guidance system that can guide a driver in a large-scale parking lot to an open parking space in a way that is easy for the driver to understand.

SUMMARY OF THE INVENTION

To achieve these objects, the present invention teaches a parking lot guidance system for guiding vehicles to empty parking spaces in a parking lot having at least one parking block, wherein each parking block containing multiple parking spaces, and multiple parking blocks are collectively called a parking area unit within the present application. It is to be understood that a parking lot in accord with the present invention may have multiple parking area units, with each parking area unit having multiple parking blocks.

The parking lot guidance system in accord with the present invention includes: a vehicle detection means for determining for each parking space, whether a vehicle is parked in the parking space; a first empty-parking-space-data-generating-means for generating image data presenting empty-parking-space-data (i.e. data indicating at least the availability of empty parking spaces) for each parking area unit based on detection results from the vehicle detection means; a second empty-parking-space-data-generating-means for generating image data presenting empty-parking-space-data (i.e. data indicating at least the location of empty parking spaces) for each parking block based on detection results from the vehicle detection means; and a transmission means for sending at the parking lot entrance and/or at each parking area unit entrance, the empty-parking-space-data for parking area units, and sending at the entrance of individual parking blocks within each parking are unit, the empty-parking-space-data for the particular parking block. Wherein the sent data is transmitted to vehicles having a receiver. The empty-parking-space-data for parking area units, and the empty-parking-space-data for each parking block is thus displayed on the display device of the vehicle to guide the driver to an empty parking space.

The system thus comprised can efficiently guide drivers to open parking spaces by first providing, at the parking lot entrance, empty parking space information for each parking are unit, and then providing, at the entrance to each parking block, the location of empty parking spaces in each parking block.

Furthermore, by displaying the empty-parking-space-data for parking are units and for individual parking blocks using images presented on a display device inside the vehicle, the guidance to empty parking spaces in the parking lot is easier for drivers to understand than the text-based and audio-based guidance provided by conventional systems.

Optical beacons are preferably used for the transmission means.

Optical beacons have a short communication range, and can therefore transmit within a locally confined range the empty-parking-space-data for parking are units and the empty-parking-space-data for each parking block.

Further preferably, the transmission means is placed at various locations in each parking block and transmits location information in the parking block to vehicles in the parking block. This enables drivers to know their location in a particular parking block.

Yet further preferably, audio information is also included in the empty-parking-space-data for parking area units and in the empty-parking-space-data for each parking block.

When thus configured, empty-parking-space-data for the parking area units and empty-parking-space-data for each parking block can be provided using both graphical (image) information and audio information. By combining both data types, guidance to empty parking spaces in the parking lot can be made even easier for drivers to understand.

Yet further preferably, information relating to the parking area units or the parking blocks is included in the empty-parking-space-data for parking area units and in the empty-parking-space-data for each parking block.

This configuration enables drivers to get information relating to stores and other businesses near the parking lot, parking area unit, or parking block. The information can, for example, be convenient for selecting a parking space near the driver's intended destination.

Yet further preferably, empty-parking-space-data for parking area units and empty-parking-space-data for each parking block is also presented on display devices placed at various locations in the parking lot.

This makes it possible to provide empty-parking-space-data for both parking area units and for each parking block to drivers in vehicles that do not have an appropriate receiver or display device.

The invention also achieves the above objects by providing a parking lot guidance program for controlling a control apparatus used in the guiding of vehicles to empty parking spaces in a parking lot, which has at least one parking are unit that in turn as at least one parking block containing multiple parking spaces. The guidance program causes the control apparatus to function as: a vehicle detection means for detecting parked vehicles in parking spaces; a first empty-parking-space data-generating-means for generating image data presenting empty-parking-space data for each parking area unit based on detection results from the vehicle detection means; a second empty-parking-space-data-generating-means for generating image data presenting empty-parking-space-data for each parking block based on detection results from the vehicle detection means; and a transmission means for sending at the parking lot entrance the empty-parking-space-data for parking area units, and for sending at the entrance to each parking block to vehicles having a receiver, the empty-parking-space-data for a particular parking block.

This program enables a control system having sensors, a data processing apparatus, and transmission means to function as a parking lot guidance system according to the present invention.

Other objects and attainments together with a fuller understanding of the invention will become apparent and appreciated by referring to the following description and claims taken in conjunction with the accompanying drawings.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIGS. 4*a* and 4*b* describe a method whereby an address memory stores availability data for each parking space.

FIG. 8 is a plan view showing an arrangement of optical beacons at various locations in parking block E.

DESCRIPTION OF THE PREFERRED EMBODIMENTS

A preferred embodiment of the present invention is described below with reference to the accompanying figures.

The configuration of a parking lot guidance system N according to the present invention is described first below.

Figure 1:
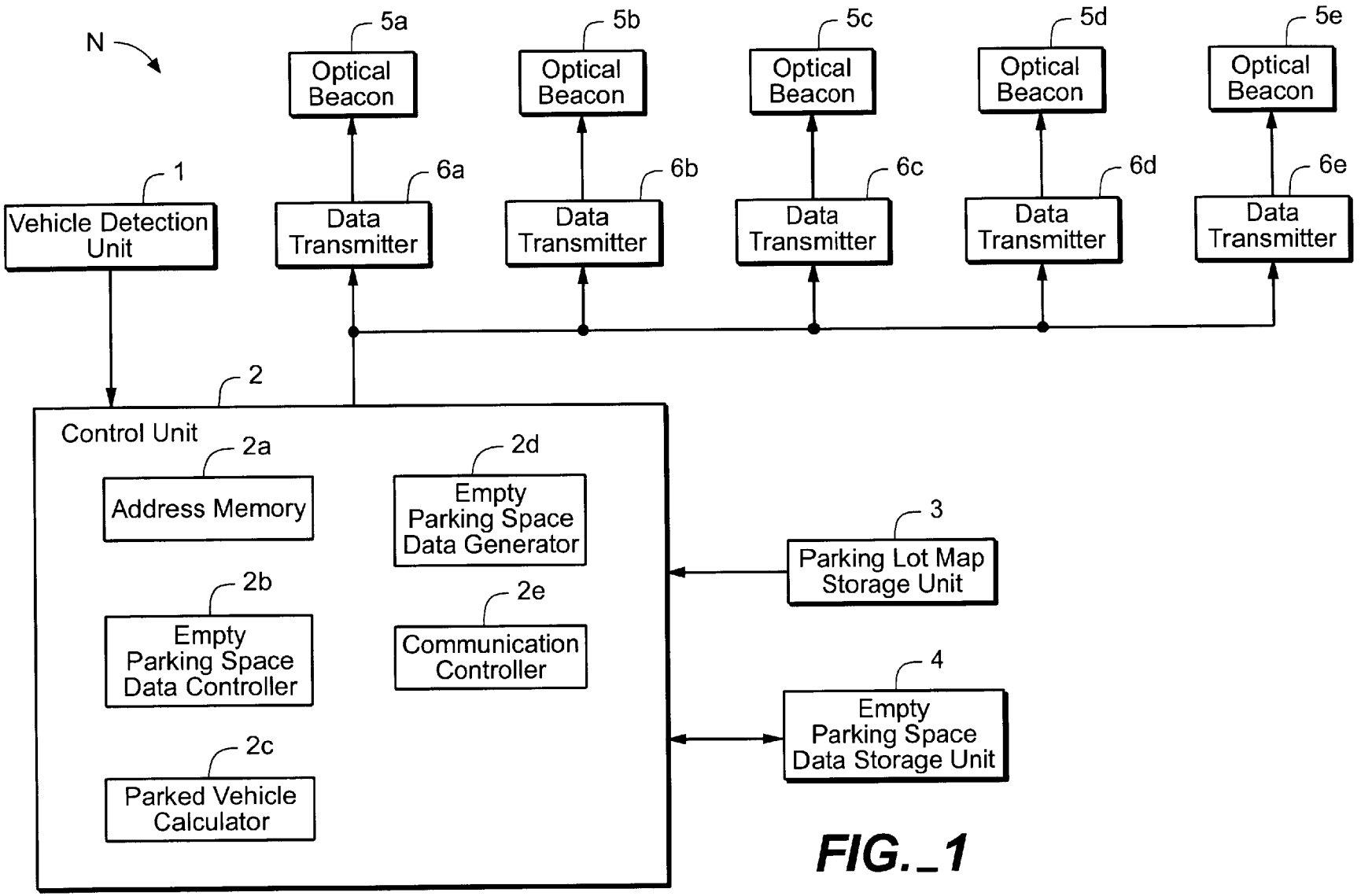
FIG. 1 is a block diagram showing the configuration of a parking lot guidance system according to the present invention.

As shown in FIG. 1, this parking lot guidance system N includes: a plurality of vehicle detection units 1 for detecting for each parking space whether a vehicle is parked in the parking space; a control unit 2 for generating parking space availability data (empty-parking-space-data) from the detection results supplied by the vehicle detection units 1; a parking lot map storage unit 3 for storing maps of the parking lot; an empty-parking-space-data storage unit 4 for storing the empty-parking-space-data generated by the control unit 2; and a plurality of data transmitters 6*a*–6*e* for sending empty-parking-space-data to optical beacons 5*a*–5*e* located throughout the parking lot.

It should be noted here that the vehicle detection unit 1 is used as a vehicle detection means, control unit 2 is used as a first empty-parking-space-data-generating-means and as second empty-parking-space-data-generating-means, and optical beacons 5 are used as a transmission means.

A personal computer (PC) or other data processing system is preferably used for the control unit 2. The control unit 2 has a CPU and internal memory, and runs programs for recording and processing information. These programs include, for example, a program for storing the detection results from the vehicle detection units 1, and a program for generating empty-parking-space-data I1 for parking area units and empty-parking-space-data I2 for each parking block from the detection results passed from the vehicle detection units 1. The vehicle detection means, first and second empty-parking-space-data-generating-means, and the transmission means achieve the corresponding functions of these programs.

Figure 2:
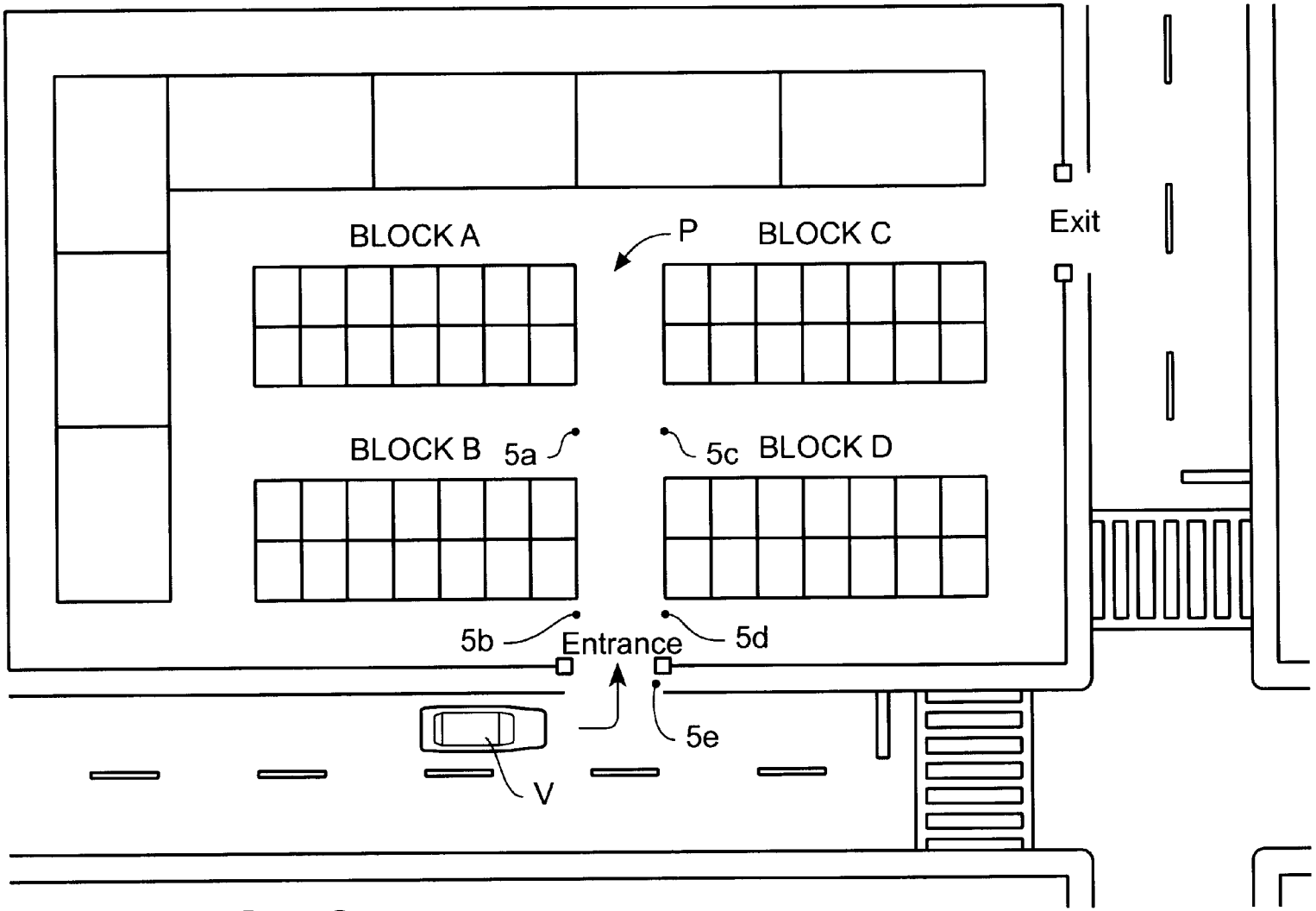
FIG. 2 is a plan view of a parking lot in accord with the present invention.

With reference to FIG. 2, parking lot guidance system N is used in to guide a vehicle V entering a parking lot P, for example, to an empty parking space somewhere in parking lot P. In this example the parking lot P is constituted by a single parking area unit having four parking blocks; block A, block B, block C, and block D. In the present example, each parking block has two rows of eight parking spaces. An optical beacon 5*e* is located at the entrance to the parking lot P, and optical beacons 5*a* to 5*d* are located at the entrance to parking blocks A to D, respectively.

A vehicle detection unit 1 (FIG. 1) is located at each parking space and detects whether a vehicle is parked in that space. A photodetector, magnetic sensor, or other means could be used for the vehicle detection unit 1. Detection results from each vehicle detection unit 1 are input to the control unit 2.

Figure 3A:
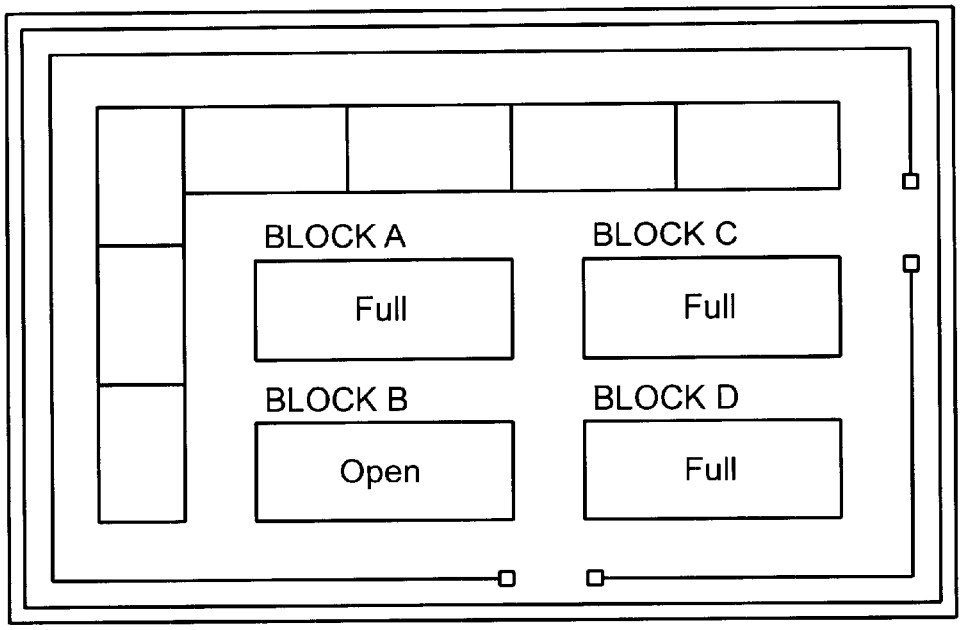
FIG. 3*a* shows a visual summary of parking space availability for each parking block, i.e. it shows empty-parking-space-data for a parking area unit, that is presented on an on-board display of a vehicle.
Figure 3B:
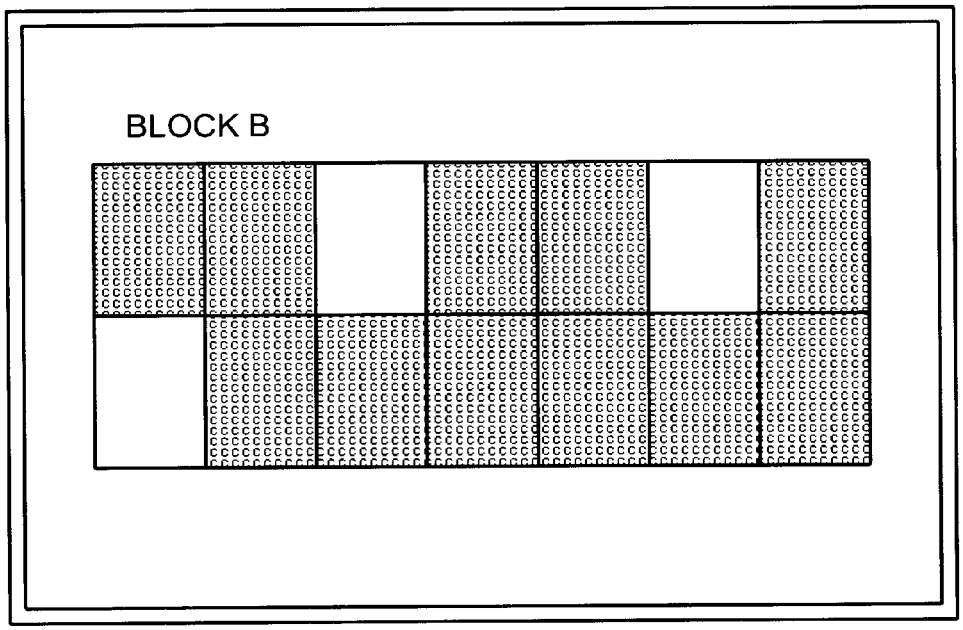
FIG. 3*b* shows the availability of individual parking spaces within exemplary parking block B, i.e. it shows the empty-space-data for parking block B, that is presented on an on-board display of a vehicle.

The control unit 2 generates first empty-parking-space-data I1 for each parking area unit, which in the present case includes parking blocks A to D, and second empty-parking-space-data I2 for each parking block A to D based on the detection results supplied from the vehicle detection units 1. The first empty-parking-space-data I1 for each parking area unit and the second empty-parking-space-data I2 for each parking block is graphically presented with a display, such as that shown in FIG. 3*a* and FIG. 3*b*. First empty-parking-space-data I1 indicates at least which parking blocks within the parking area unit are empty and which are not empty (i.e. which have open parking spaces), as shown in FIG. 3*a*. Second empty-parking-space-data I2 indicates at least which individual parking spaces within a specific parking block are empty and which are opened, as shown in FIG. 3*b* for exemplary block B. The first empty-parking-space-data I1 for each parking area unit and the second-parking-empty-space-data I2 for each parking block is transmitted by optical beacons 5 to vehicle V and preferably presented on a display in vehicle V.

As shown in FIG. 3*a,* the empty-parking-space-data I1 for each parking area unit includes information indicating whether there is an empty parking space in a particular parking block within the parking area unit. If an open parking space is available in a particular parking block, message "OPEN", for example, is displayed for that parking block. If there are no available spaces in the parking block, message "FULL", for example, is displayed. It is to be understood that in addition to, or in place of, message indicator "Open", the number of open spaces within each parking block may also be indicated.

The empty-parking-space-data I2 for each respective parking block is information indicating the location of each empty parking space within each respective parking block. The information is preferably displayed using a format such as shown in FIG. 3*b.* In the example shown in FIG. 3*b,* the occupied spaces are colored or darkened (shown as shaded in the figure). It will also be obvious that the method of indicating empty parking spaces in each parking block shall not be so limited, and various techniques can be used.

Presenting the empty-parking-space-data I1 for each parking area unit (note, only one parking area unit is shown in the present example) and the empty-parking-space-data I2 for each parking block shall not be limited to graphic or visual displays, and can also be provided audibly. Using the case shown in FIG. 3*a*, the guidance system could announce the availability of an open parking space in a particular parking block by outputting from a speaker an audible message stating, "a space is available in block B", for example. Furthermore, the location of empty parking spaces in the parking lot can be made even easier to understand by combining graphic displays with spoken output.

Returning to FIG. 1, control unit 2 has address memory 2*a* for storing the address of each empty parking space, an empty parking space data controller 2*b* for controlling the updating of parking space availability data when vehicles enter and leave parking spaces, a parked vehicle calculator 2*c* controlled by the empty parking space data controller 2*b* for calculating how many vehicles are parked in each parking block, an empty parking space data generator 2*d* controlled by the empty parking space data controller 2*b* for writing empty-parking-space-data to a parking lot map stored in the parking lot map storage unit 3, and a communication controller 2*e* controlling the data transmitters 6 for sending empty parking space data to the optical beacons 5.

As shown in FIG. 4*a,* the address memory 2*a* stores the address assigned to each parking space within each parking block. As shown in FIG. 4*b,* it also stores a value indicating whether each parking space is opened or occupied based on the detection results from corresponding vehicle detection units 1. As shown in FIG. 4*b*, for example, a 0 is stored when a parking space is empty, i.e. opened, and a 1 is stored when a parking space is occupied. These values can then be easily read to determine parking space availability.

When the data indicating parking space availability stored in address memory 2*a* is updated, the empty parking space data controller 2*b* controls the updating of the empty-parking-space-data for the parking lot. To do this it controls the parked vehicle calculator 2*c* and empty parking space data generator 2*d* to update the empty-parking-space-data I1 for each parking block a parking area unit, as indicated in FIG. 3*a*. It then controls the empty parking space data generator 2*d* to update the more detailed empty-parking-space-data I2 for each parking block A-D, as indicated in FIG. 3*b*.

The parked vehicle calculator 2*c* calculates the number of vehicles parked in each parking block from the space availability data stored in the address memory 2*a,* and determines the presence of any empty parking spaces in each parking block.

Referring to FIG. 4*b,* for example, all parking spaces are occupied in parking blocks A, C, and D, and the parked vehicle calculator 2*c* therefore determines that there are no empty parking spaces available in blocks A, C, and D. Empty parking spaces are available in parking block B, however, and the parked vehicle calculator 2*c* therefore determines that an empty space is available in parking block B.

The parking lot map storage unit 3 stores a parking lot map M1 representing the entire parking lot, and a parking block map M2 showing the parking spaces in each parking block. The parking lot map also preferably stores a separate map for each parking area unit within the parking lot. For example, if the parking lot were a multi-story (i.e. multi-level) parking lot, then each floor of the multi-story parking lot may be defined as a separate parking area unit, and the map for each parking area unit would indicate the parking space availability status of all the parking blocks within the parking area unit. In the present example, however, parking lot P constitutes a single parking area, and therefore only one map, M1, is necessary. If the parking lot included multiple parking area units, then a separate display indicated which parking area units within the parking lot have available parking spaces may be provided.

Alternatively, each floor of the multi-story parking lot may be defined as a separate parking block, and it would therefore not be necessary to sub-divide the parking lot into multiple parking area units. This is more akin to the examples of FIGS. 2 and 8, which is described in more detail below.

Figure 5A:
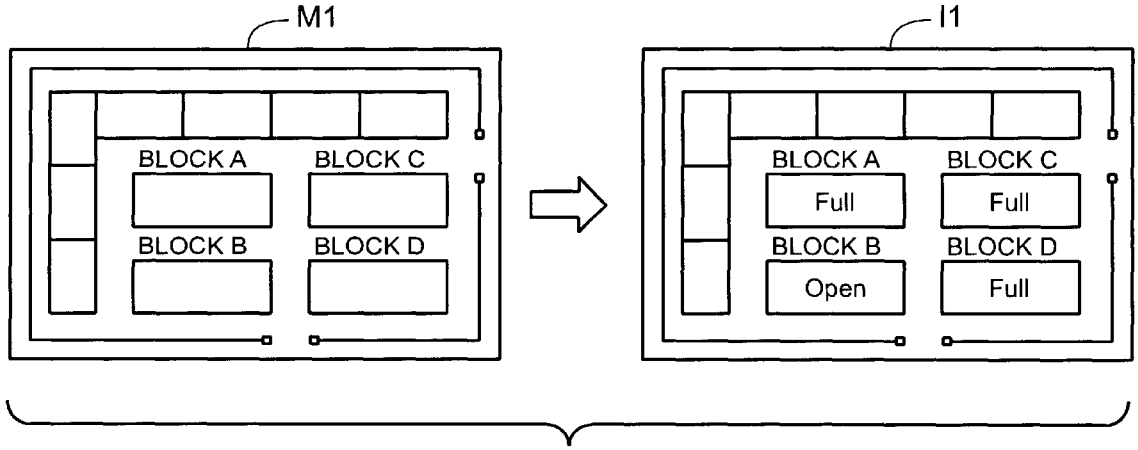
FIGS. 5*a* and 5*b* describes a method whereby an empty parking space data generator generates empty-parking-space-data for the parking lot.

Returning to the present embodiment, based on the results from the parked vehicle calculator 2*c,* the empty parking space data generator 2*d* generates empty-parking-space-data I1 for each parking area unit by writing OPEN or FULL to the appropriate parking block indicator within parking lot map M1, as shown in FIG. 5*a.*

Figure 5B:
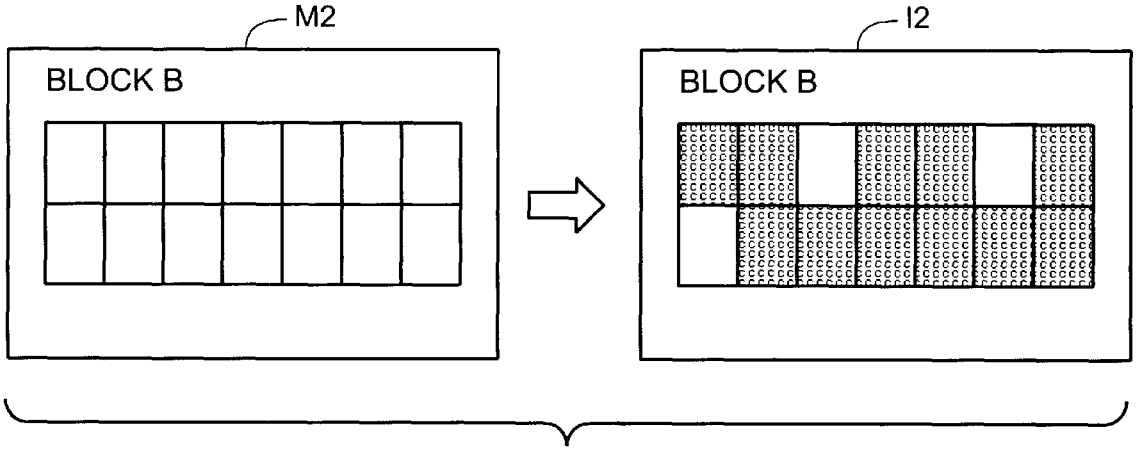

Based on the data indicating parking space availability stored in the address memory 2*a,* the empty parking space data generator 2*d* also generates the empty-parking-space-data I2 for each parking block by coloring in, or darkening, the occupied spaces (shown as shaded areas in the figures) in the parking block map M2 as shown in FIG. 5*b.*

The empty-parking-space-data I1 for each parking area unit, i.e. for parking lot P, and empty-parking-space-data I2 for each parking block generated by the empty space data generator 2*d* is then stored into empty space data storage unit 4.

The communication controller 2*e* controls the data transmitters 6*a* to 6*e* to send the empty-parking-space-data I1 for each parking block within a parking area unit to the optical beacon 5*e* located at the entrance to the parking lot P, and the empty-parking-space-data I2 for individual parking spaces within each parking block to the corresponding optical beacon 5*a* to 5*d* located at the entrance to each parking block.

More specifically, the communication controller 2*e* controls data transmitter 6*e* to send the empty-parking-space-data I1 for each parking block within a parking area unit (i.e. within parking lot P) to optical beacon 5*e,* and controls data transmitters 6*a* to 6*d* to send the empty-parking-space-data I2 for each parking block to optical beacons 5*a* to 5*d,* respectively.

Other information relating to parking lot P can also be presented on the parking lot map M1, and other information relating to a particular parking block can also be presented on the parking block maps M2.

Figure 6:
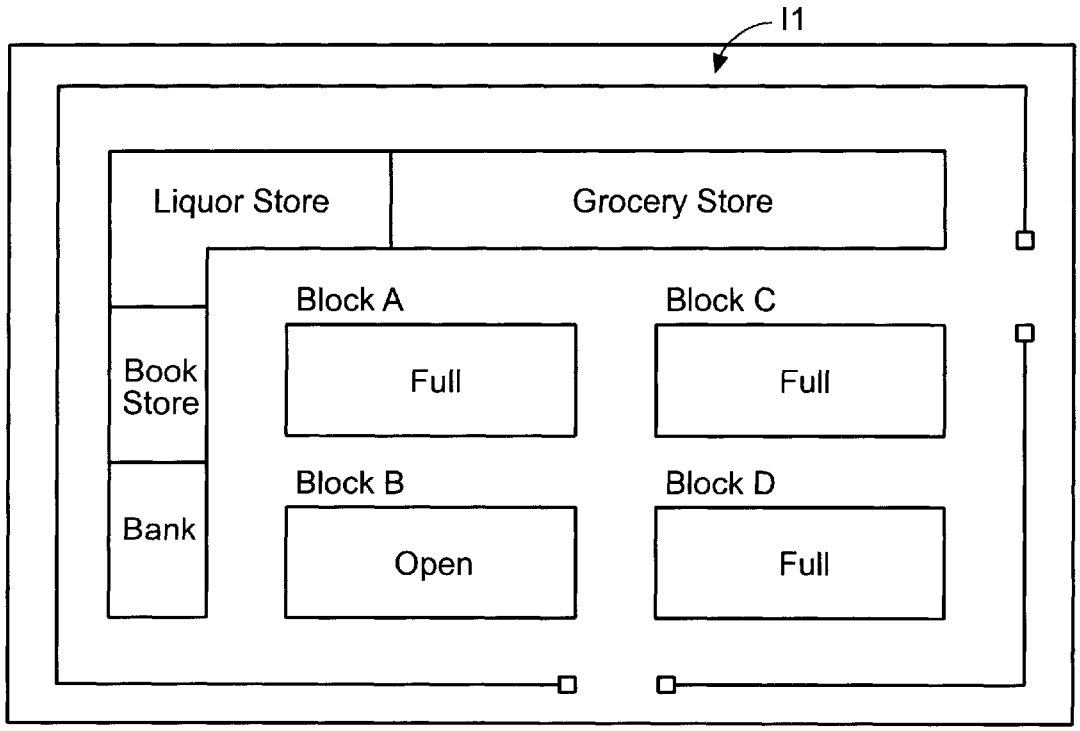
FIG. 6 shows an exemplary presentation of store information on a map showing the entire parking lot.

For example, information about stores or businesses (referred to as "store information" below) near parking lot P could be displayed on the parking lot map M1. If a grocery store, liquor store, bookstore, and bank are tenants of the shopping center adjacent to the parking lot P, as shown in FIG. 2 for example, this store information could be displayed as shown in FIG. 6. Drivers could then refer to this store information display and select a parking space closer to their intended destination.

The empty-parking-space-data I1 for each parking block within a parking area unit, or parking lot, and the empty-parking-space-data I2 for each parking block generated by the empty space data generator 2*d* of the control unit 2 is stored into empty parking space data storage unit 4. Empty-parking-space-data I1 and I2 is held in memory until the updating of the empty-parking-space-data I1 for each parking block within a parking area unit and the updating of the empty-parking-space-data I2 for each parking block is commanded by the empty parking space data controller 2*b*.

Optical beacons 5 are located at various spots around the parking lot P as indicated in FIG. 2. As noted above, an optical beacon 5*e* is located at the entrance to the parking lot P and optical beacons 5*a* to 5*d* are located at the entrance to individual parking blocks A-D in parking lot P, as shown in FIG. 2.

Figure 7:
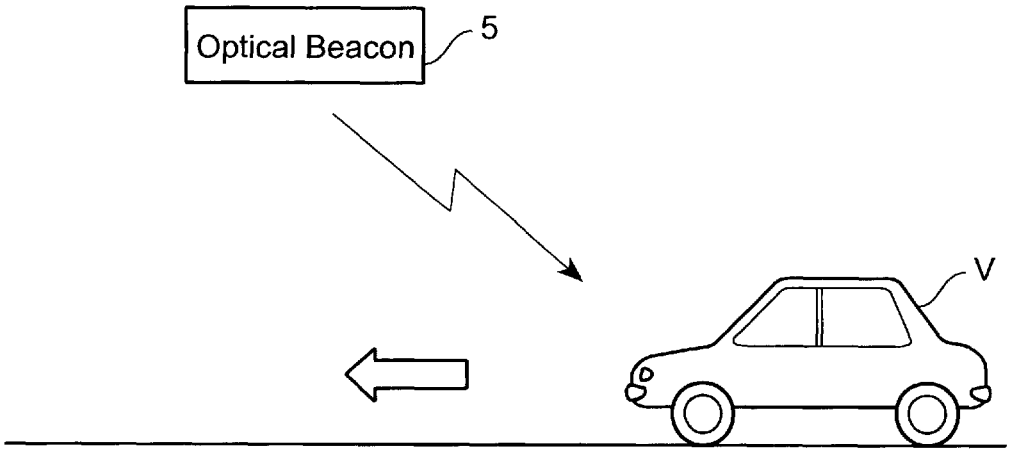
FIG. 7 describes a method whereby optical beacons send empty-parking-space data to vehicles.
Figure 9A:
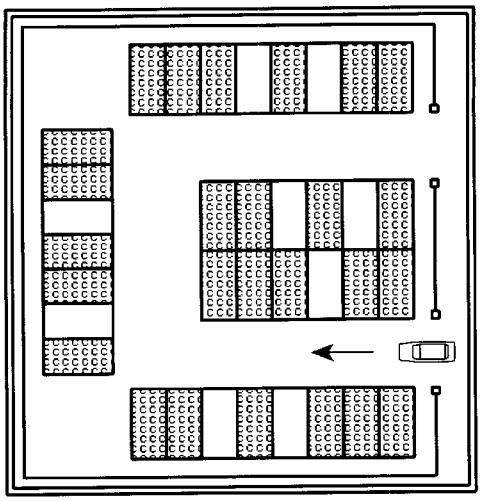
FIG. 9 shows the location information of a moving vehicle in parking block E received by the vehicle.
Figure 9B:
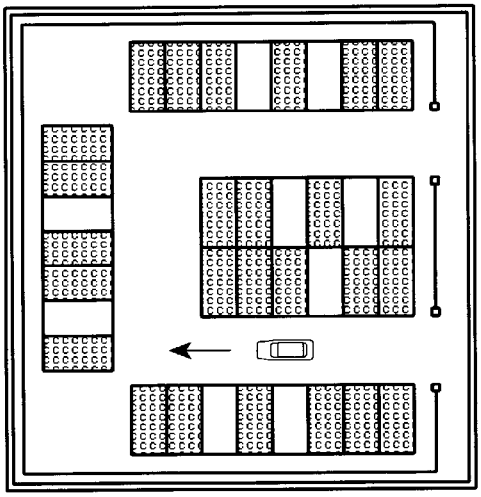
Figure 9C:
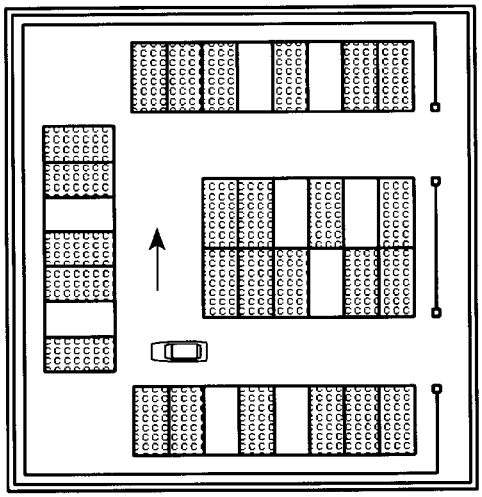
Figure 9D:
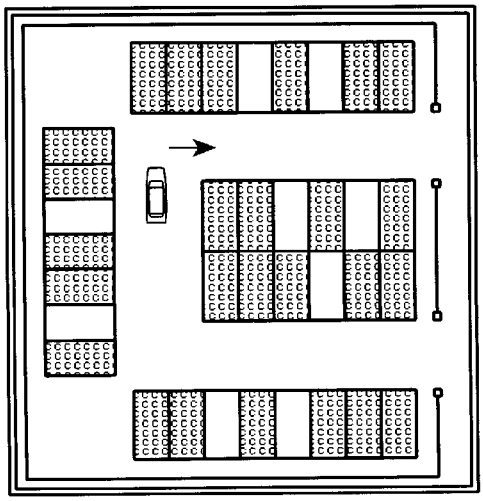
Figure 9E:
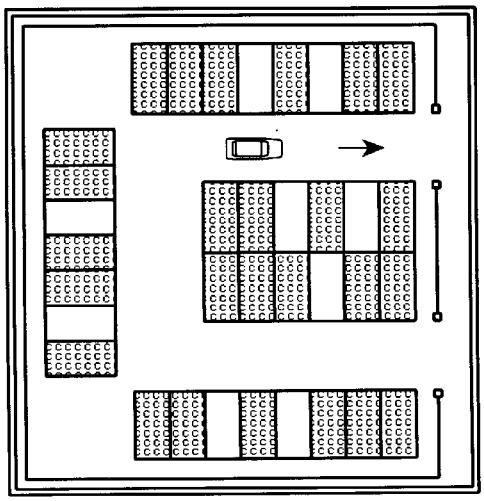

As shown in FIG. 7, the optical beacons 5 sends the empty-parking-space-data I1 for each parking block within a parking lot, or parking area unit, and also sends empty-parking-space-data I2 for each parking block to each vehicle V passing directly under the beacon.

The optical beacon 5*e* located at the entrance of parking lot P transmits the empty-parking-space-data I1 indicating the "Open" or "Full" status for each parking block. The optical beacons 5*a* to 5*d* located at the entrance to each respective parking block A-D transmit the empty-parking-space-data I2 for that respective parking block. The empty-parking-space-data I1 or empty-parking-space-data I2 for a particular parking block received by a vehicle V is then presented on the onboard display (see FIG. 3).

The number of optical beacons 5 located at each parking block is not specifically limited. More specifically, the optical beacons 5 are preferably disposed as needed throughout the parking lot so that a vehicle V can also receive parking block location information from the optical beacons 5.

With reference to FIG. 8, consider, for example, a parking lot Q that is different from parking lot P shown in FIG. 2, and that has a parking block E with five optical beacons 5*f*, 5*g*, 5*h*, 5*i*, and 5*j* located around parking block E. By sending images as shown in FIGS. 9*a*–9*e* indicating the current location of the vehicle V in parking block E each time the vehicle V passes below one of the optical beacons 5*f* to 5*j*, a person driving through parking lot Q can know his/her current location in parking block E.

A data transmitter 6 is disposed for each of the optical beacons 5 as shown in FIG. 1, and sends empty-parking-space-data I1 indicating the "Open" or "Full" state of each parking block and empty-parking-space-data I2 indicating the location of opened parking spaces in each parking block appropriate to the location of a local optical beacon 5 to all other optical beacons 5.

More specifically, data transmitter 6*e* corresponds to optical beacon 5*e* and sends the empty-parking-space-data I1 to optical beacon 5*e*. Data transmitters 6*a* to 6*d* correspond to optical beacons 5*a* to 5*d* and send empty-parking-space-data I2 for each parking block to the corresponding optical beacon 5*a* to 5*d*.

The means for transmitting data from the data transmitters 6 to the optical beacons 5 is not specifically limited to wireless communication, but wireless communication is preferable due to installation cost and other factors.

Figure 10:
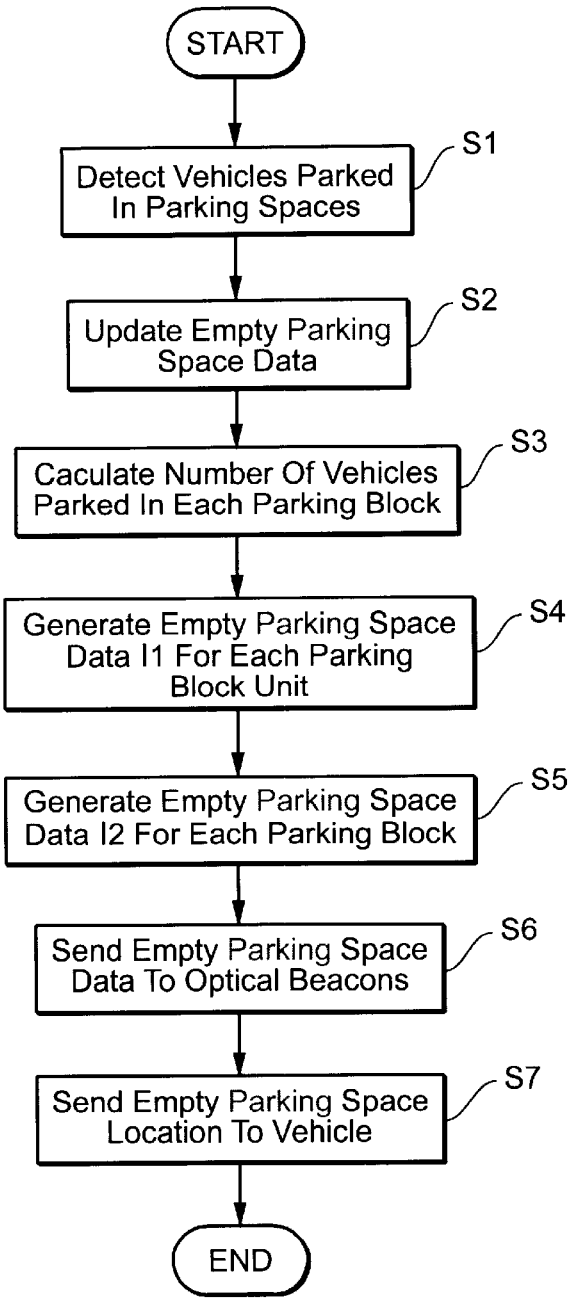
FIG. 10 is a flow chart of the operation of parking lot guidance system N of FIG. 1.

Operation of this parking lot guidance system N is described next below with reference to the flow chart in FIG. 10.

The vehicle detection units 1 first detect vehicles parked in the parking spaces (step S1). The detection results are then stored in the address memory 2*a* of control unit 2 as values indicating whether each parking space is open or occupied.

When a vehicle detection unit 1 detects that a vehicle has entered or left a parking space, the empty space data controller 2*b* commands updating the parking lot availability data (step S2). Note that updating the parking lot availability data means generating new empty-parking-space-data.

The parked vehicle calculator 2*c* then calculates the number of vehicles parked in each parking block from the data stored in the address memory 2*a* of control unit 2 indicating the availability of each parking space, and determines whether there are any empty spaces in each parking block (step S3).

Based on the results from the parked vehicle calculator 2*c*, the empty space data generator 2*d* then generates empty-parking-space-data I1 for each parking block such as shown in FIG. 3 (step S4). This empty-parking-space-data I1 for each parking block is stored into empty parking space data storage unit 4.

The control unit 2 also generates empty parking-space-data I2 for each parking block such as shown in FIG. 3*b* from the space availability data stored to the address memory 2*a* (step S5). Like the empty space data I1 for each parking block unit, this empty-parking-space-data I2 for each parking block is stored into the empty parking space data storage unit 4.

Data transmitter 6*e* then sends the empty-parking-space-data I1 for each parking block to optical beacon 5*e* (step S6). Data transmitters 6*a* to 6*d* send the empty-parking-space-data I2 for each parking block to the corresponding optical beacons 5*a* to 5*d*.

The optical beacon 5*e* at the parking lot P entrance then sends the empty-parking-space-data I1 indicating the "Open" or "Full" state of each parking block to vehicles V passing directly below (step S7). The optical beacons 5*a* to 5*d* at the entrance to each parking block similarly send the empty-parking-space-data I2 indicating the location of opened parking spaced within each parking block to each vehicle V passing directly below the beacon.

Figure 11:
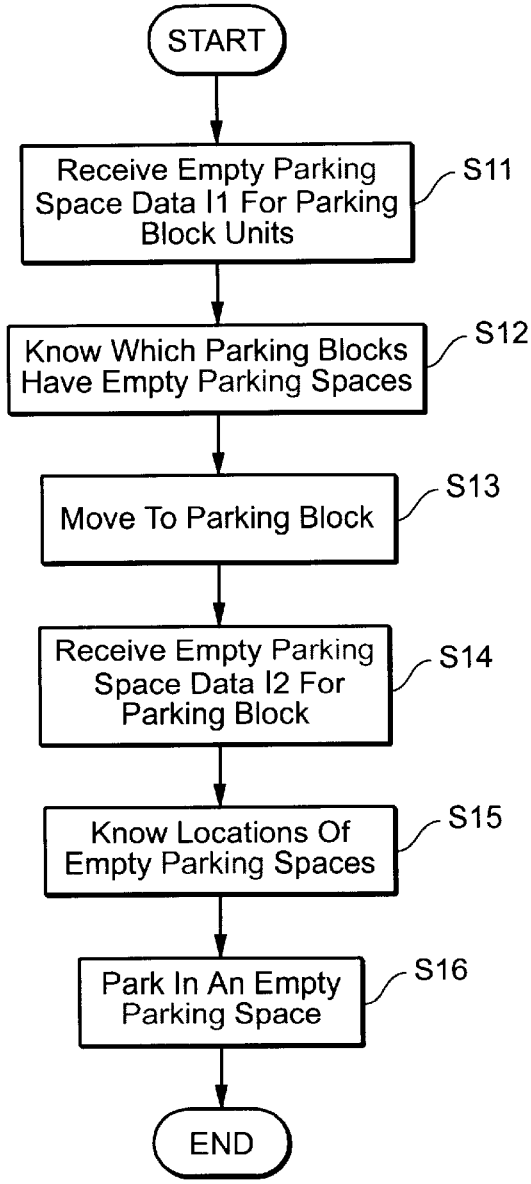
FIG. 11 is a flow chart of a method for guiding a vehicle entering the parking lot to an empty parking space.

The method whereby the parking lot guidance system N of this invention guides a vehicle V entering the parking lot P to an open parking space is described next with reference to the flow chart in FIG. 11.

This process starts with a vehicle V receiving at the entrance of parking lot P, the empty-parking-space-data I1 indicating the "Open" or "Full" state of each parking block (step S11). This empty space data I1 for each parking block unit is preferably displayed on an on-board display of the vehicle as indicated in FIG. 3*a*. The parking lot P user (i.e. the driver) then knows which parking blocks have empty parking spaces by looking at empty-parking-space-data I1 presented on the display (step S12). Based on the empty-parking-space-data I1 for each parking block, the driver then drives the vehicle V to a parking block where an open space is indicated (step S13).

The vehicle V then receives empty-parking-space-data I2 for each parking block at a parking block entrance (step S14). This empty-parking-space-data I2 is preferably also displayed on the vehicle's on-board display as indicated in FIG. 3*b*. By looking at the displayed empty-parking-space-data I2, the driver can then know the location of each empty parking space in parking block that the driver is entering (step S15). Based on this empty-parking-space-data I2, the driver then drives the vehicle V to an empty parking space, and parks (step S16).

A preferred embodiment of a parking lot guidance system according to the present invention has been described above, and it will be obvious to one with ordinary skill in the related art that the invention shall not be limited thereto and can be varied in many ways. For example, this parking lot guidance system N shall not be limited to a two-dimensional parking lot such as shown in FIG. 2, and can also be applied to multi-level parking garages. In this case, space availability data (i.e. empty-parking-space-data I1) for each parking level (floor) is transmitted to vehicles at the parking garage entrance, and empty space data (i.e. empty-parking-space-data I2) for each level is transmitted at the entrance to each parking level.

Display devices could also be displayed at various locations throughout the parking lot or parking garage for displaying the empty-parking-space-data I1 for each parking block within a parking lot, parking area, or parking floor, and displaying the empty-parking-space-data I2 for each parking block. This makes it possible to provide empty-parking-space-data for the parking lot and for individual parking blocks to vehicles that do not have a suitable receiver and display device.

[Benefits of the Invention]

As would be understood from the preceding description, the present invention provides empty-parking-space-data I1 at the entrance to the parking lot, provides empty-parking-space-data I2 for a parking block at the entrance to the respective parking block, and is therefore able to efficiently guide parking lot users (drivers) to unoccupied parking spaces.

Furthermore, by displaying a pictorial representation of empty-parking-space-data I1 and I2 on a display device inside the vehicle, information identifying the locations of empty spaces in the parking lot can be presented to drivers in a way that is easier to understand than the text displays and audio output used by the prior art.

Furthermore, by using optical beacons as a transmission means, the empty-parking-space-data I1 and I2 can be transmitted locally.

Yet further, by locating the transmission means at various places throughout the parking lot and sending parking block location information to the vehicles, drivers can know their own location in the parking lot.

Furthermore, by including audio information in the empty-parking-space-data I1 and/or I2, the empty-parking-space-data can be provided with both graphic, i.e. pictorial, information and audible information. As a result, guidance to empty parking spaces in the parking lot can be made even easier for the driver to understand.

It is yet further possible to include other information relevant to a parking lot or parking block within empty-parking-space-data I1 and/or I2. Parking lot users can get information about stores near the parking lot and/or near each parking block, for example. This is particularly convenient for selecting a desirable parking space.

Empty-parking-space-data I1 and I2 can also be displayed on display devices located around the parking lot. This enables the empty space data to be provided even to vehicles that do not have a suitable receiver and on-board display device.

A control system having sensors, a data processing apparatus, and transmission devices for guiding vehicles to empty parking spaces in a parking lot having multiple parking blocks each containing multiple parking spaces can also be driven to function as the parking lot guidance system of the present invention by driving the control unit to function as: a vehicle detection means for detecting a parked vehicle in each parking space; a first empty parking space data generating means for generating image data presenting (i.e. a pictorial image representing) empty-parking-space-data indicating the "Open" or "full" state of each parking block based on detection results from the vehicle detection means; a second empty parking space data generating means for generating image data presenting empty-parking-space-data indicating the location of opened parking spaces within each parking block based on detection results from the vehicle detection means; and a transmission means for sending the empty-parking-space-data indicating the "Open" or "full" state of a parking blocks at the parking lot entrance, and for sending empty-parking-space-data indicating the location of opened parking spaces within a particular parking block at the entrance to that particular parking block, to vehicles having a receiver.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A parking lot guidance system for guiding a vehicle to an empty parking space in a parking lot divided into at least one parking block having multiple parking spaces, said parking lot comprising:

vehicle detector for detecting parked vehicles in said parking spaces;

a first parking space data generator for generating first parking data including at least a pictorial representation of parking availability data for said parking block based on detection results from said vehicle detector, wherein said parking availability data indicates at least whether any parking spaces are available within said parking block;

a second parking space data generator for generating second parking data including at least a pictorial representation of parking space location data for said parking block based on detection results from said vehicle detector, wherein said parking space location data indicates which of said multiple parking spaces are available and their relative location within said parking block; and a transmitter for sending said first parking data to said vehicle at the entrance to said parking lot, and for sending said second parking data to said vehicle at the entrance to said parking block;

wherein said vehicle has a display device for displaying said first and second parking data, whereby said vehicle is guided to an empty one of said multiple parking spaces.

2. A parking lot guidance system as described in claim 1, wherein said transmitter include optical beacons.

3. A parking lot guidance system as described in claim 2, wherein said optical beacons are placed at various locations within said parking block and transmit said second parking data for the parking block within which they are placed.

4. A parking lot guidance system as described in any of claims 1, wherein audio information is included within said first and second parking data.

5. A parking lot guidance system as described in any of claims 1, wherein information relating to said parking lot is included within said first parking data and information relating to said parking block is included within said second parking data.

6. A parking lot guidance system as described in any of claims 1, wherein said first and second parking data is presented on a plurality of display devices placed at various locations in said parking lot.

7. A parking lot guidance system as described in claim 1, wherein said parking lot includes a plurality of said parking blocks, each having a plurality of respective parking spaces, wherein:

said first parking space data generator generates a separate, respective one of said parking availability data for each of said plurality of parking blocks, and pictorial representations of each of said respective parking availability data is included in said first parking data; and said second parking space data generator generates a separate, respective one of said parking space location data for each of said plurality of parking blocks, and pictorial representations of said respective parking space location data is included in said second parking data.

8. A parking lot guidance program causing a control apparatus for guiding a vehicle to an empty parking space in a parking lot having at least one parking block containing multiple parking spaces to function as:

vehicle detector for detecting parked vehicles in said parking spaces;

a first parking space data generator for generating first parking data including a pictorial representation of parking space availability data for said parking block based on detection results from said vehicle detector, wherein said parking availability data indicates at least whether any parking spaces are available within said parking block;

a second parking space data generator for generating second parking data including a pictorial representation parking space location data for said parking block based on detection results from said vehicle detection means, wherein said parking space location data indicates which of said multiple parking spaces are available and their relative location within said parking block; and transmitter for sending said first parking space data to said vehicle at the entrance to said parking lot, and for sending said second parking space data to said vehicle at the entrance to said parking block.

* * * * *